US008056604B2

(12) United States Patent
Duncan et al.

(10) Patent No.: US 8,056,604 B2
(45) Date of Patent: Nov. 15, 2011

(54) PROCESS FOR PREPARING A TEST CASTING AND TEST CASTING PREPARED BY THE PROCESS

(75) Inventors: Flavia Cunha Duncan, Dublin, OH (US); Jorg Kroker, Powell, OH (US); Steven Johnston, Marysville, OH (US)

(73) Assignee: Ask Chemicals L.P., Wilmington, DE (US)

( * ) Notice: Subject to any disclaimer, the term of this patent is extended or adjusted under 35 U.S.C. 154(b) by 100 days.

(21) Appl. No.: 12/554,330

(22) Filed: Sep. 4, 2009

(65) Prior Publication Data

US 2011/0056643 A1 Mar. 10, 2011

(51) Int. Cl.
*B22D 46/00* (2006.01)

(52) U.S. Cl. ..... 164/4.1; 164/150.1

(58) Field of Classification Search ..... 164/4.1, 164/150.1, 134, 358, 359
See application file for complete search history.

(56) References Cited

U.S. PATENT DOCUMENTS 3,409,579 A 11/1968 Robins et al.
3,485,797 A 12/1969 Robins et al.
3,676,392 A 7/1972 Robins
3,965,962 A * 6/1976 Tanaka et al. ..... 164/55.1
4,154,289 A * 5/1979 Jeanneret ..... 164/358
4,391,642 A 7/1983 Stevenson et al.
4,526,219 A 7/1985 Dunnavant et al.
4,750,716 A 6/1988 Reeve-Parker
4,985,489 A 1/1991 Barker et al.

OTHER PUBLICATIONS

Flavia C. Duncan and Jorg Kroker, "Difficulties in Controlling and Measuring Flake Skin in CGI" Metal Casting Technologies, 53(3), 62 (2007).
International Search Report and Written Opinion from the ISA received in the corresponding PCT application, mailed Oct. 21, 2010.

* cited by examiner

*Primary Examiner* — Kevin P Kerns
(74) *Attorney, Agent, or Firm* — Standley Law Group LLP

(57) ABSTRACT

A test casting is useful for predicting the severity of skin that will form when compacted graphite iron or ductile iron is cast using a selected foundry mix. The mold is made from the foundry mix and has a gating system with at least two ingates, and with a hollow cylindrical shape associated with each ingate. The hollow cylindrical shapes are substantially the same height, but the diameter of each varies by at least 20% from the diameter of any of the other cylindrical shapes. Molten metal poured into the gating system fills each of the hollow cylindrical shapes. When the metal cools and solidifies, a solid cylinder of the metal is produced in each hollow cylindrical shape. The solid metal cylinders, each with a distinct diameter, are cut and inspected to measure the skin formed thereon.

13 Claims, 6 Drawing Sheets

PROCESS FOR PREPARING A TEST CASTING AND TEST CASTING PREPARED BY THE PROCESS

BACKGROUND

It is well known that control of "skin" formation in compacted graphite iron castings and ductile iron castings is critical to their mechanical performance, particularly fatigue strength. The formation of skin with degenerated graphite morphology in the casting periphery can decrease the strength and ductility of the casting to a far greater extent than the relative thickness of the skin might suggest because graphite flakes in particular can act as stress concentrators and crack initiation sites. The ability to control the degradation of vermicular or spheroidal graphite in the casting skin requires a fundamental understanding of the effects of metal composition and treatment, inoculant fade in the furnace prior to pouring and in the mold after pouring, mold/metal reactions inside the mold and cooling rates during solidification of the metal.

Generation of test castings is a common methodology used by industry and academic research groups in an effort to correlate data from laboratory or small scale metal casting operations to production operations and specific commercial castings. Many examples exist for test casting designs and geometries to address specific topics, for instance mold erosion, metal penetration, veining, lustrous carbon formation, etc., but none that specifically address the effect of skin formation in compacted graphite iron and/or ductile iron as a result of molding materials, mold/metal interface reactions and cooling rates of the metal upon pouring and filling the mold.

Although the phenomenon of skin formation and its causes are acknowledged and the effect is commonly probed via metallurgical microstructure evaluation, a suitable test which not only shows the effect but also allows one to investigate contributors such as cooling rates and the effect of molding materials, including aggregate, sand additives, binders, refractory coatings and the like does not exist.

FIGURES

FIG. 1 is an image of the inner surface of the left half mold used to prepare the mold assembly for the test casting, including the gating system, four hollow cylindrical shapes, and riser cavities for each of the four hollow cylindrical shapes.

FIG. 2 is an image of the inner surface of the right half mold used to prepare the mold assembly for the test casting, including the gating system, four hollow cylindrical shapes, and riser cavities for each of the four hollow cylindrical shapes.

FIG. 3 is an image of the top view of the mold assembly showing the openings for the downsprue in the center and riser cavities of the four hollow cylindrical shapes, two on each side of the downsprue.

FIG. 4 is an image of the casting broken away from mold assembly showing both mold halves and the test casting.

FIG. 5 is an image of the test casting prepared using the mold assembly shown in FIGS. 3 and 4.

Figure 5:
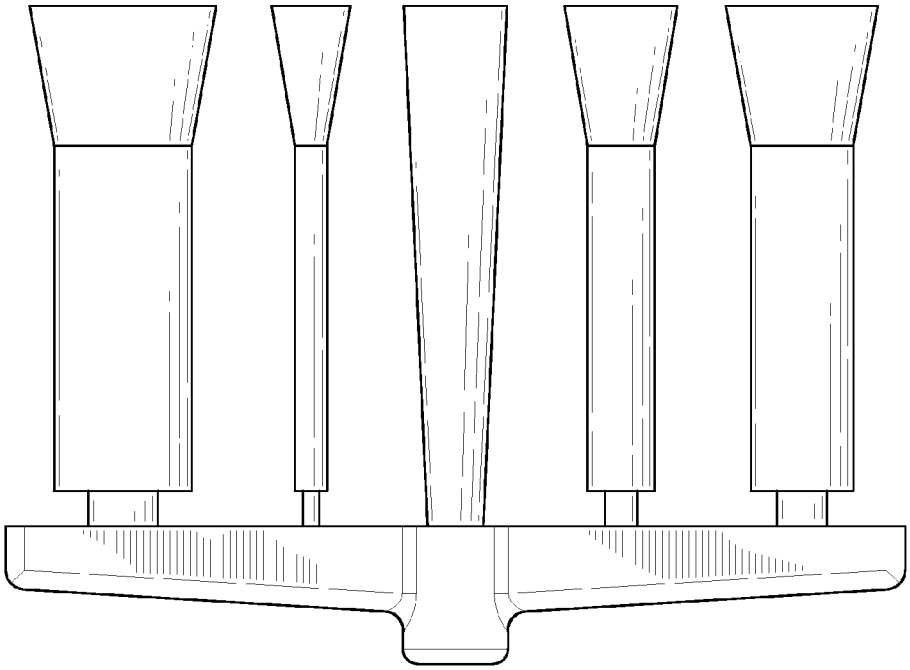
Figure 6:
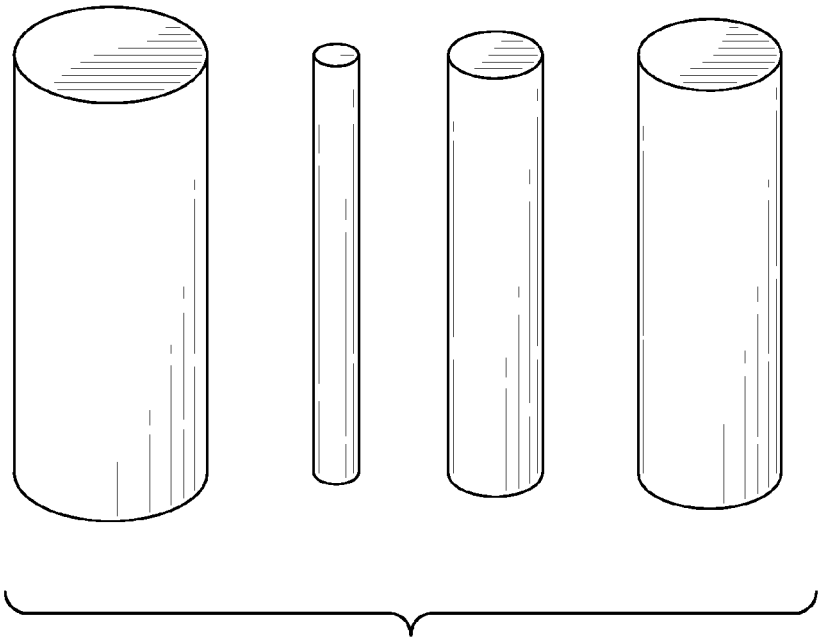

FIG. 6 consists of drawings of the four solid metal cylinders that have been removed from the test casting shown in FIG. 5 by cutting them away from the gating system and the riser.

Figure 7:
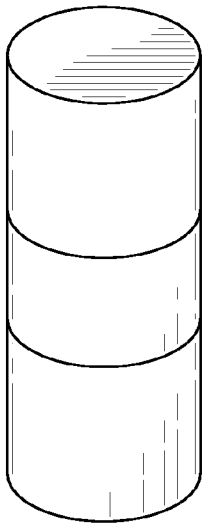

FIG. 7 is a drawing showing how a test disc that was cut perpendicularly from a solid metal cylinder shown in FIG. 6.

SUMMARY

This disclosure relates to a one-pour process for preparing a metal test casting useful for predicting the severity of skin that will form on a casting made of compacted graphite iron or ductile iron and the test casting prepared by the process. The process comprises:

(a) preparing a refractory mold assembly configured such that the mold assembly comprises
  (i) a gating system comprising a downsprue, runner system, and at least two ingates, and
  (ii) two or more hollow and substantially cylindrical shapes having substantially the same height and different diameters, such that there is an ingate to each of the hollow cylindrical shapes of the mold assembly,
(b) pouring molten compacted graphite iron or ductile iron into the mold assembly through the downsprue,
(c) allowing the molten compacted graphite iron or ductile iron to pass through the gating system to fill the hollow cylindrical shapes of the mold assembly,
(d) allowing the molten metal to cool to solidify into a metal test casting having two or more solid metal cylinders,
(e) removing the test casting from the mold assembly, and
(f) measuring the skin formed on the solid metal cylinders of the metal test casting.

The disclosure also relates to the test casting prepared by the process, solid test cylinders that can be removed from the test casting, and tests discs that can be cut from the solid test cylinders.

The test casting is particularly useful for predicting the severity of skin that will form on a casting made of compacted graphite iron or ductile iron because only one pour is required to create a metal casting having several solid cylinders. Because the solid cylinders of the casting are produced with one pour, no casting result variability should be attributed to different pouring conditions, chemistry of the poured metal, amount of inoculant used, oxygen entrainment, and inoculant fade prior to pouring. Shrink defect-free solid cylinders can be produced if the mold assembly has a properly designed riser cavity above the top of the hollow cylindrical shape of the mold.

The test casting is also useful because the metal that fills each of the hollow cylinders of the mold assembly experiences different cooling rates depending on the location in the mold assembly. Skin formation is largely determined by the cooling rate at the metal mold interface. Metal in a large diameter cylinder cavity will generally cool slower than metal in a smaller diameter cylinder cavity. Furthermore, the cooling rate at the metal/mold interface is larger near the bottom end of each cylinder, i.e. near the ingate, than at the top of each cylinder, i.e. near the riser.

Visual microscopic examination of each of the perpendicularly sectioned solid cylinders of the casting provides information about how skin formation is affected by the choice of the aggregate, sand additive, sand binder type, refractory coating, and cooling rate. The examination of the solid cylinders can also be performed on specimen obtained from co-directionally sectioned portions of the solid cylinders to reveal more information that can be used to predict what metallurgical features a casting may have on a production scale.

DETAILED DISCLOSURE

To produce the mold constituents and mold assembly which is used to prepare the test casting, any and all processes known to produce foundry shapes such as foundry molds can be applied, including no-bake, cold-box and heat-cured processes. The components typically used to produce the molds are a refractory, a binder, and a curing catalyst.

Any and all binder types as commonly used in conjunction with no-bake, cold-box and heat-cured processes to generate foundry shapes including foundry molds can be applied, i.e., core oil binders, amine cured phenolic-urethane and polyol-urethane binders, oil urethane binders, acid cured furfuryl alcohol based binders, inorganic binders such as cementitious binders, ester and $CO_2$ cured silicate based binders, alumina phosphate, alumina silicate and metal salt binders, $SO_2$ cured furfuryl alcohol and epoxy-acrylic binders, acid cured and ester cured phenolic binders, including alkaline phenolic resole binders.

Illustrative examples of refractories that can be used to make the molds include silica, magnesia, alumina, olivine, chromite, zircon, aluminosilicate, and carbon among others. These refractories are used in major amounts, typically in amounts of at least 90 weight percent based upon the total weight of the refractory plus binder, more typically at least 95 weight percent.

The amount of binder needed is an effective amount to maintain the shape of the mold and allow for effective curing. Usually the binder level ranges from about 0.5 weight percent to about 5 weight percent based upon the weight of the refractory.

Phenolic urethane binders are described in U.S. Pat. Nos. 3,676,392, 3,485,797 and 3,409,579, which are hereby incorporated into this disclosure by reference. These binders are based on a three-part system, one part being a phenolic resin component, the other part being a polyisocyanate component and the third part being a curing catalyst. The epoxy-acrylic binders cured with sulfur dioxide in the presence of an oxidizing agent are described in U.S. Pat. No. 4,526,219, which is hereby incorporated into this disclosure by reference.

In order to prepare the mold components used to make the mold assembly used to make the test casting, the no-bake process using phenolic urethane binders has been found to be particularly suitable. Usually, the phenolic resin component is first mixed with the aggregate and then the polyisocyanate component is added. Methods of distributing the binder components onto the aggregate particles are well known to those skilled in the art. This foundry mix is molded into the desired shape such as a mold or core, and cured.

Curing by the no-bake process takes place by mixing a liquid amine curing catalyst into the foundry mix, shaping it by compacting it into a pattern, and allowing it to cure, typically at ambient temperature without the addition of heat, as described in U.S. Pat. No. 3,676,392, which is hereby incorporated into this disclosure by reference. The preferred liquid curing catalyst is a tertiary amine and the preferred no-bake curing process is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, N-vinyl imidazole, 4,4'-dipyridine, 4-phenylpropylpyridine, 1-methylbenzimidazole, and 1,4-thiazine.

Curing the mold by the cold-box process takes place by blowing or ramming a foundry mix into a pattern and contacting the mold with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor or amine vapor diluted with an inert gas such as nitrogen is used with phenolic-urethane cold-box binders. Examples for suitable amines include trimethyl amine, dimethylethyl amine, triethyl amine, dimethylpropyl amine and dimethyl-iso-propyl amine.

Sulfur dioxide or sulfur dioxide diluted with an inert gas such as nitrogen (in conjunction with an oxidizing agent contained in the binder) is used with epoxy-acrylic binders. See U.S. Pat. No. 4,526,219 which is hereby incorporated into this disclosure by reference. Carbon dioxide (see U.S. Pat. No. 4,985,489 which is hereby incorporated into this disclosure by reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642 which is hereby incorporated into this disclosure by reference.

The size of the mold assembly should be chosen such that it can be readily produced with typical laboratory sand mixing equipment and subsequently handled in a safe and confident manner, from a perspective of size, weight and requirement of liquid metal to fill the cavity which produces the test casting. The liquid metal volume requirement must be commensurate with the ladle size. While it is preferred to use the test casting mold assembly for a one-pour process, the option to pour multiple mold assemblies from one ladle is also desirable.

The size of the test bar cavities in the mold assembly must be such that a wide range of cooling rates can be achieved between the smallest and the largest hollow cylinders. Finally, the size of the smallest diameter cylinder should be chosen so that the achievable cooling rates are within a range which is of practical relevance for both compacted graphite iron and ductile iron.

Of course, different molding aggregates will allow for easy adjustment to accomplish very specific cooling rate targets. Generally, too small of a diameter results in cooling rates which may be too fast to be practically relevant. Lastly the length of the hollow cylinders should be such that multiple specimen discs can be cut safely from each bar for preparation of the test specimen.

Figure 1:
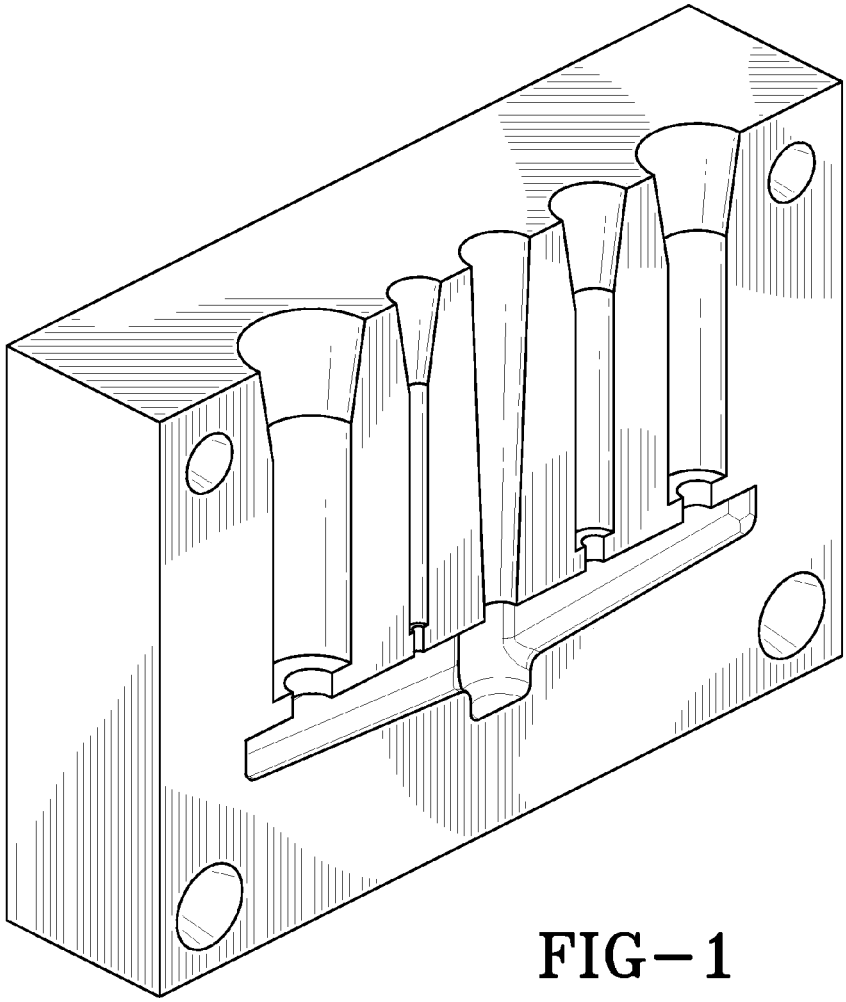
FIGS. 1-7 are images of the mold components, the mold assembly, the test casting and test bars used in Examples 1-6.
Figure 2:
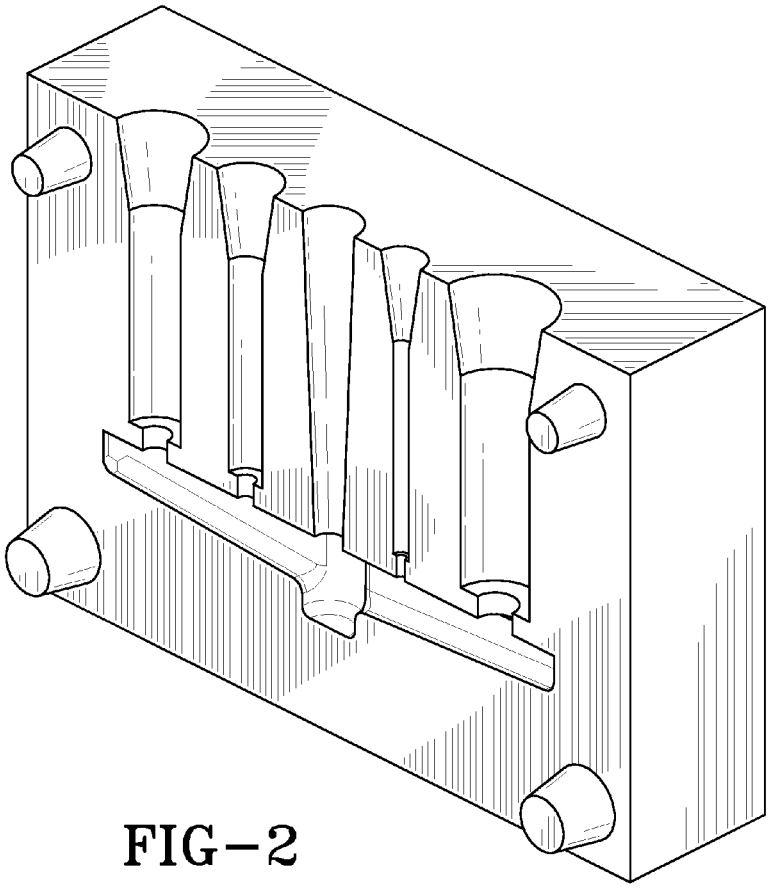
Figure 3:
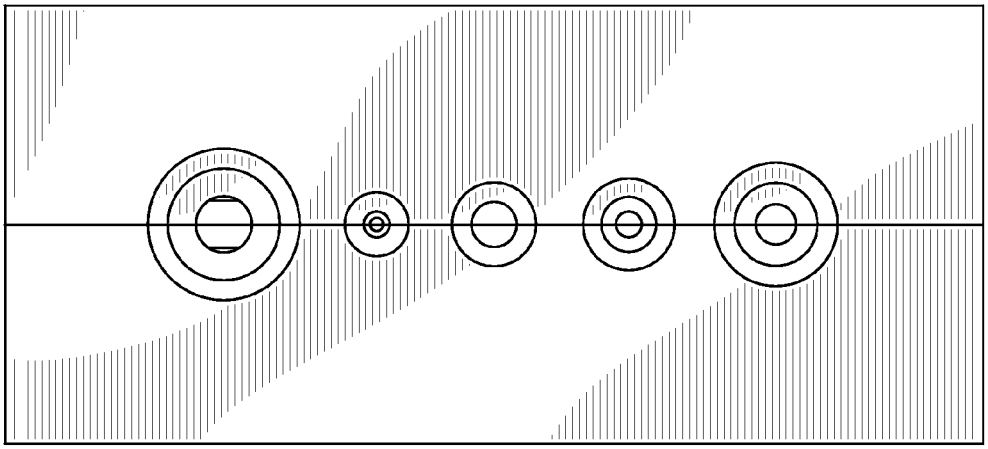
Figure 4:
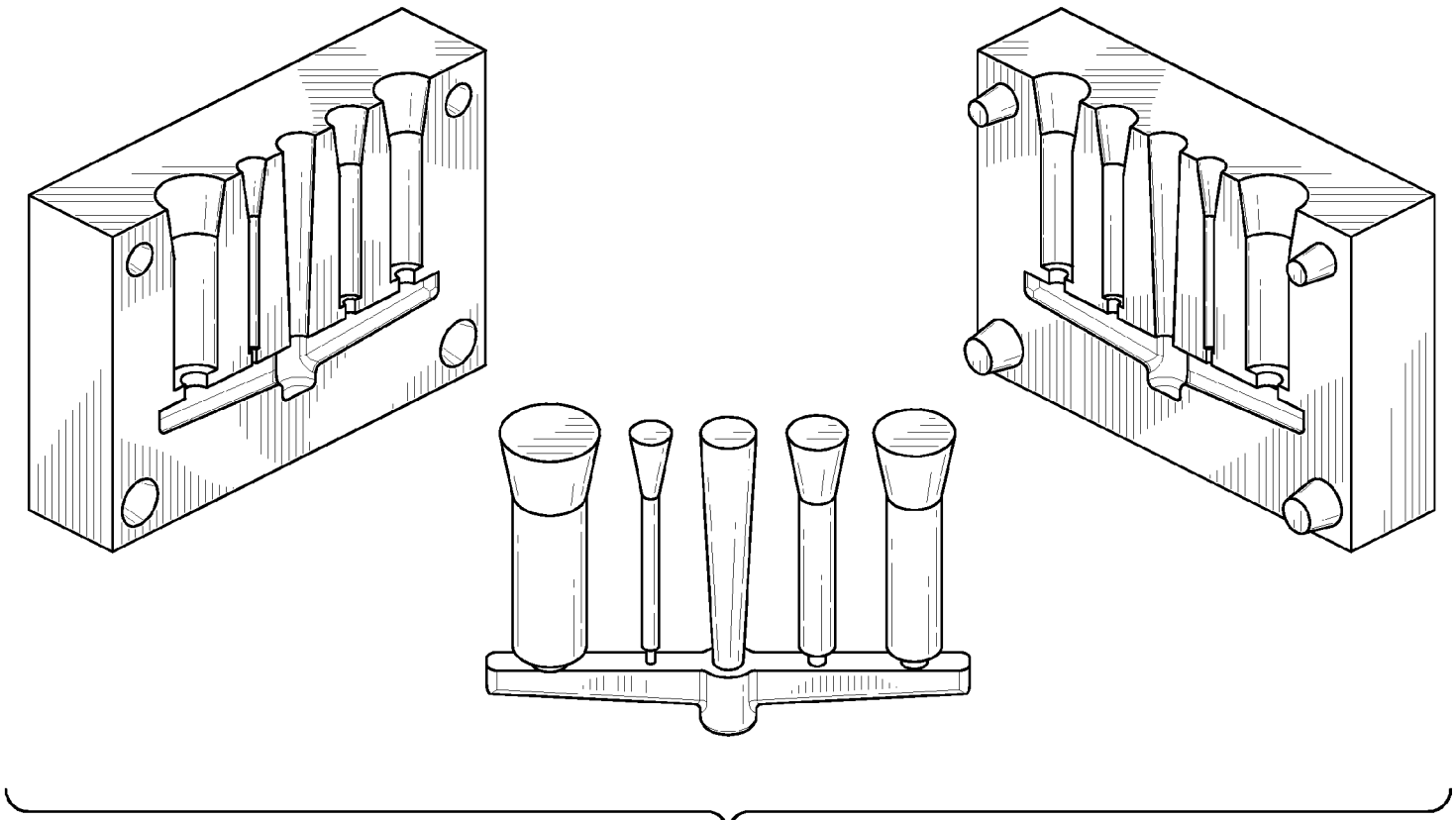

The preferred test casting mold is one in which 2 separate mold halves as shown in FIGS. 1 and 2 and each measuring about 37.5 centimeters×8 centimeters×24.5 centimeters (length by width by height) are joined, resulting in a mold assembly with vertical parting line, as shown in FIG. 3 and a cavity pattern comprising a gating, runner, ingate and feeder system that feeds at least 4 vertically oriented hollow cylindrical cavities to produce a test casting as shown in FIGS. 4 and 5 from which test cylinders as shown in FIG. 6, each 100 millimeters tall and with individual diameters of 40, 10, 20 and 30 millimeters, respectively, can be obtained. Preferably, the shape of the ingates through which the liquid metal enters the hollow cylinder is circular, and the ratio of ingate diameter-to-cylinder diameter is 1:2.

EXAMPLES

Mold assemblies were prepared to produce the test castings. The mold assemblies had (a) a gating system consisting of a downsprue, runner, and ingates, (b) four hollow cylindrical shapes of the same height (100 mm) and different diameters (10; 20; 30 and 40 mm), and (c) a riser cavity for each of the four hollow cylindrical shapes. Two of the four hollow cylindrical shapes were located on each side of the downsprue.

The mold assemblies were obtained by preparing the left half mold shown in FIG. 1 and the right half mold shown in FIG. 2 using a no-bake process by mixing an aggregate, one weight percent of phenolic urethane no-bake binder system (PEP SET® X1000/X2000 supplied by Ashland Inc.), and five weight percent of liquid amine curing catalyst (PEP SET® 3501 catalyst, supplied by Ashland Inc.) where the weight percent of the binder is based upon the weight of the aggregate and the weight percent of the curing catalyst is based upon the weight of the binder. The weight ratio of the Part I (phenolic resin component) to Part II (polyisocyanate component) was about 55/45.

In order to prepare the mold halves, the aggregate, binder, and catalyst were mixed together for approximately two minutes using an industrial batch mixer. The mixture was then dispensed into pattern boxes for each mold half, where it was compacted and allowed to harden. The mold halves were then stripped from the box when a green hardness of 70 was reached. The mold halves were then glued together using a 2-component urethane adhesive (OMEGASET® 300/305 LB supplied by Ashland Inc.) to form the mold assembly for preparing the test casting. In Examples 1-3, three different aggregates were used to make the molds. In Examples 4-6, three different coatings were used to coat the interior of one of the two mold halves before they were glued together and the molten metal was poured into the downsprue of the mold assembly.

Table 1 discloses the aggregates and coatings that were used in Examples 1-6.

The dimensions (length by width by height) of the mold assembly was 37.5 centimeters×16 centimeters×24.5 centimeters. The height of the four hollow cylindrical shapes was 100 mm and the diameter of the hollow cylindrical shapes was 40 mm, 10 mm, 20 mm, and 30 mm (from left to right in FIG. 1, respectively).

TABLE 1

Aggregates and refractory coatings used to prepare the mold assemblies which were used to produce the test castings

| Example | Aggregate type | Refractory coating type |
|---|---|---|
| 1 | A | none |
| 2 | B | none |
| 3 | C | none |
| 4 | A | Mica + Aggregate type C |
| 5 | A | Zircon |
| 6 | A | Mica |

A: Silica sand (Wedron 540 supplied by Wedron Silica Co.)

B: Chromite sand (Hevi-Sand ® supplied by American Colloid Co.)

C: Aluminosilicate microspheres (EXACTHERM ® Sand Replacement supplied by Ashland Inc.)

Molten compacted graphite iron having a temperature of approximately 1510° C. was transferred from the furnace into a ladle from where it was then poured at approximately 1400° C. through the downsprue of the mold assembly to fill the mold and provide excess metal in the riser cavities of the mold. The filling of the mold assembly took about 4-6 seconds. The composition of the compacted graphite iron is set forth in Table 2.

TABLE 2

Metal composition before and after pouring as determined by Optical Emission Spectroscopy

| | Source of the metal | | | |
|---|---|---|---|---|
| | % C | % Mg | % S | % Si |
| Furnace | 3.78 | <0.001 | 0.013 | 2.39 |
| Ladle | 3.81 | 0.008 | 0.012 | 2.60 |
| Casting | 3.76 | 0.008 | 0.012 | 2.88 |

After the metal cooled, a test casting such as that shown in FIG. 4 was formed and extracted from the mold assembly. The four solid cylinders of the test casting were then separated from the gating system by sawing off right above the ingate using a band saw. The riser metal was also sawed off, leaving 4 separate metal cylinders as shown in FIG. 5 with diameters of (from left to right) 40, 10, 20 and 30 mm, respectively, each 100 mm tall. The solid cylinders were then perpendicularly cut at about 50 mm from the bottom of each test cylinder. Then test specimen discs (20 mm thick) were cut from the end where the test cylinder was cut in half, as shown in FIG. 7. The discs were mounted in acrylic resin and the side of the cross sectional disc which represents the 50 mm length side of the original test bar was ground and polished for the metallographic analysis. This was done by using grinding papers of increasing fineness of 50, 120, 240, 320, 400 and 600 grit, followed by polishing with an abrasive alumina slurry until no visible scratches remain on the surface. Prior to grinding paper grit change the sample was rotated 90° for the removal of scratches from the previous direction and creation of new ones in the new direction.

The discs were then viewed under a light microscope at 100× magnification for evaluation and analysis of the test specimen. When skin thickness surpassed the field of observation the magnification was decreased to 50×. In order to ascertain comparability of the analysis results, it is important that all specimens are oriented under the microscope at the same location for every specimen. The microscopic images of the interior of the test discs provide information regarding the metallurgical properties of the bulk metal of the casting. Of particular interest was the thickness of the "skin" on the test disc, which was measured and recorded. Tables 3 and 4 provide information related to how skin formation is affected by choice of aggregate and coating.

TABLE 3

Skin thickness in millimeters as a function of mold aggregate

| | Test Bar Diameter [mm] | | | |
|---|---|---|---|---|
| Example | 10 | 20 | 30 | 40 |
| 1 | 0 | 0 | >0-0.2 | >0-0.2 |
| 2 | 0 | >0-0.2 | >0-0.2 | >0-0.2 |
| 3 | >0.4-0.6 | >0.4-0.6 | >0.4-0.6 | >0.4-0.6 |

The results in Table 3 indicate that both silica sand (A) and chromite sand (B) are preferred over aluminosilicate microspheres (C) as molding aggregate for making compacted graphite iron castings, because the use of hollow aluminosilicate microspheres as molding aggregate resulted in severe skin formation on the casting.

TABLE 4

Skin thickness in millimeters as a function of refractory coating applied to the mold

| | Test Bar Diameter [mm] | | | |
|---|---|---|---|---|
| Example | 10 | 20 | 30 | 40 |
| 4 | 0 | >0-0.2 | >0.2-0.4 | >0.6 |
| 5 | >0-0.2 | >0-0.2 | >0.4-0.6 | >0.6 |
| 6 | 0 | >0-0.2 | >0.2-0.4 | >0.4-0.6 |

The results in Table 4 indicate that for making compacted graphite iron castings the mica-based refractory coating used in Example 6 is clearly preferred over the zircon-based refractory of Example 5 because the latter resulted in more severe skin formation. The mica-based refractory coating used in Example 6 also resulted in thinner skin than the aluminosilicate containing mica-based coating used in Example 4, as suggested by the result obtained with the 40 mm test bar.

The microscopic images obtained from the test specimen can also be used to evaluate the metallurgical morphology of the bulk metal of the test specimen. Cooling rates of the liquid metal inside the mold assembly at the metal/mold interface were obtained by calculating the first derivative of a time versus temperature curve simulated with MAGMASOFT 4.4 supplied by MAGMA Foundry Technologies Inc. Correlation of these calculated cooling rates as disclosed in Table 5 for the different mold aggregates with the microscopic images obtained from the test specimen suggest that the faster the cooling rate of the compacted graphite iron in the mold is, the higher is the tendency to result in a morphology rich in spheroidal graphite or high nodule count, which is indicative of ductile iron. Conversely it was found that the slower the cooling rate, the higher is the tendency to result in a morphology rich in vermicular graphite, which is characteristic of compacted graphite iron.

TABLE 5

Effect of mold aggregate on compacted graphite iron molten metal cooling rate at different temperatures (calculated for the location at the mold/metal interface, 50 mm from the ingate of the cylindrical shape)

| Aggregate type | Test bar diameter [mm] | Cooling rate at 1250° C. [° C./s] | Cooling rate at 1200° C. [° C./s] |
|---|---|---|---|
| A | 10 | 23 | 19 |
| A | 20 | 9 | 7 |
| A | 30 | 5 | 3 |
| A | 40 | 3 | 2 |
| B | 10 | 26 | 21 |
| B | 20 | 9 | 7 |
| B | 30 | 5 | 4 |
| B | 40 | 3 | 2 |
| C | 10 | 1.8 | 1.5 |
| C | 20 | 0.6 | 0.4 |
| C | 30 | 0.4 | 0.3 |
| C | 40 | 0.3 | 0.2 |

The analysis of the bulk metal morphology as represented by the interior of the test bars suggested that the slowest cooling rate as observed with the aluminosilicate microspheres (C) used as the mold aggregate resulted in the highest level of vermicular graphite which is characteristic for compacted graphite iron. However, as demonstrated in Examples 1-3 skin formation was more severe with molds made from hollow aluminosilicate microspheres C (Example 3) whereas both silica sand (A) and chromite sand (B) molds resulted in minimal skin formation. This demonstrates that cooling rates alone should not be considered as the only variable to probe and predict the quality of the compacted graphite iron casting or the ductile iron casting throughout, i.e. in the bulk sections and the peripheral sections of the casting and demonstrates the abundance of information that can be derived from the disclosed one-pour test casting design and the process to prepare the test casting.

All publications, patents and patent applications cited in this specification are herein incorporated by reference, and for any and all purposes, as if each individual publication, patent or patent application were specifically and individually indicated to be incorporated by reference. In the case of inconsistencies, the present disclosure will prevail.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A one-pour process for preparing a metal test casting having two or more solid cylinders of different diameters useful for predicting the severity of skin that will form on a casting made of compacted graphite iron or ductile iron comprising:

(a) preparing a refractory mold assembly configured such that a mold thereof comprises
  (i) a gating system comprising a downsprue, runner system, and at least two ingates, and
  (iii) two or more hollow and substantially cylindrical shapes having substantially the same height and different diameters, such that there is an ingate to each of the hollow cylindrical shapes of the mold,
(b) pouring molten compacted graphite iron or ductile iron into the mold assembly through the downsprue,
(c) allowing the molten compacted graphite iron or ductile iron to pass through the gating system to fill the hollow cylindrical shapes of the mold,
(d) allowing the molten compacted graphite iron or ductile iron to cool to solidify into a metal test casting having two or more solid cylinders,
(e) removing the test casting from the mold assembly, and
(f) measuring the skin formed on the solid metal cylinders of the metal test casting.

2. The process of claim 1 wherein at least one of the hollow cylindrical shapes of the mold is on one side of the downsprue of the mold assembly and at least one of the hollow cylindrical shapes of the mold is on the other side of the downsprue.

3. The process of claim 2 wherein the ingate of each hollow cylinder is configured such that the amount of time to fill each of the hollow cylinders with metal is substantially the same.

4. The process of claim 3 wherein the mold is further configured such that each hollow cylinder of the mold has a riser cavity above the hollow cylinder.

5. The process of claim 3 wherein the refractory used to prepare the mold assembly is selected from the group consisting of silica sand, chromite sand, zircon sand, olivine sand, carbon sand, aluminosilicates, including mullite and hollow microspheres, and mixtures thereof.

6. The process of claim 5 wherein the surface of one or more of the hollow cylinders of the mold assembly is coated with a refractory coating.

7. The process of claim 6 wherein the solid cylinders of the test casting are separated from the test casting.

8. The process of claim 1, wherein:

the binder used to prepare the mold assembly is selected from the group consisting of amine cured phenolic urethane and polyol urethane binders, $SO_2$ cured furfuryl alcohol and epoxy-acrylic binders, acid cured and ester cured phenolic binders, ester cured and $CO_2$ cured silicate based binders and alumina silicate and alumina phosphate based binders.

9. The process of claim 1, further comprising the step of:

measuring, during step (d), the cooling rate of the metal that fills each hollow cylinder of the mold assembly.

10. The process of claim 1, wherein step (f) comprises the substeps of:

cutting perpendicularly through a section of one of the solid cylinders of the test casting, to form a test disc; and predicting the severity of skin that will form on a casting made using the mold assembly by viewing the test disc under a microscope to observe the degree of skin formation thereon.

11. The process of claim 1, wherein:

the two or more hollow and substantially cylindrical shapes formed in step (a) are sized such that each cylindrical shape has a diameter that varies from the diameter of any of the other cylindrical shapes by at least 20%.

12. A method for assessing the severity of skin formation in a metal product that is cast in a mold comprising a selected refractory mold composition, comprising the steps of:

preparing, from a foundry mix comprising the selected refractory mold composition, a refractory mold assembly with a mold comprising:

a gating system comprising a downsprue, a runner system, and at least two ingates, and at least two hollow and cylindrical shapes of substantially the same height, with each cylindrical shape having a diameter that varies from the diameter of any of the other cylindrical shapes by at least 20%, each hollow cylindrical shape having a corresponding one of the ingates associated therewith;

pouring molten metal into the mold assembly through the downsprue, such that the molten metal flows through the gating system and fills each of the hollow cylindrical shapes;

allowing the molten metal to cool and solidify in the mold assembly, producing a test casting having at least two solid cylinders of the metal, the solid cylinders corresponding to the hollow cylindrical shapes, removing the test casting from the mold assembly, and measuring the skin formed on the solid metal cylinders of the metal test casting.

13. The process of claim 12, wherein:

the step of measuring the skin formed comprises the substeps of:

cutting perpendicularly through a section of one of the solid cylinders of the test casting, to form a test disc; and viewing the test disc under a microscope to observe the degree of skin formation thereon.

* * * * *